United States Patent [19]

Thomas

[11] 4,214,323

[45] Jul. 29, 1980

[54] RAISED TOILET SEAT APPARATUS

[75] Inventor: Morton I. Thomas, Nyack, N.Y.

[73] Assignee: Temco Products, Inc., Passaic, N.J.

[21] Appl. No.: 934,081

[22] Filed: Aug. 16, 1978

[51] Int. Cl.[2] ..... A47K 13/00; A47K 13/08; A47K 13/26

[52] U.S. Cl. ..... 4/237; 4/239; 297/253

[58] Field of Search ..... 4/134, 234–239, 4/240, 241; 182/126; 248/240, 240.1, 500, 503.1, 505; 297/250, 253, 216, 310

[56] References Cited

U.S. PATENT DOCUMENTS

| | | | |
|---|---|---|---|
| 2,804,630 | 9/1957 | Gould | 4/239 |
| 2,880,786 | 4/1959 | Black | 4/239 |
| 3,349,413 | 10/1967 | Merelis | 297/253 X |
| 3,594,831 | 7/1971 | Brewer | 4/237 |
| 4,047,757 | 9/1977 | Eames | 297/253 X |

*Primary Examiner*—Stuart S. Levy

*Attorney, Agent, or Firm*—Richard C. Woodbridge

[57] ABSTRACT

A raised toilet seat apparatus includes anti-tipping structure which is compatible with a wide variety of conventional commodes. The anti-tipping structure comprises a pair of L-shaped brackets connected to the raised toilet seat and a locking bar held in position by the mounting bolts on the hinged toilet seat of the converted commode. A gap is formed between the locking bar and the surface of the commode by a pair of spacer washers. The locking brackets each include a horizontal foot section which is snuggly receivable in the gap. The entire apparatus may be easily installed by slipping the foot sections of the locking brackets under the locking bar. Conversely the entire apparatus may be easily removed. The locking brackets may be modified with spacers so as to accomodate institutional toilets having their mounting bolts set further back from the rim of the bowl. The locking bar may also take a variety of shapes including wire and washer forms.

6 Claims, 14 Drawing Figures

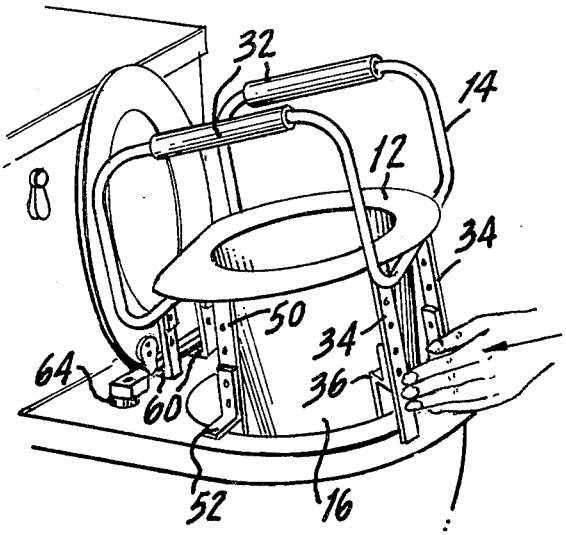
Fig. 5.
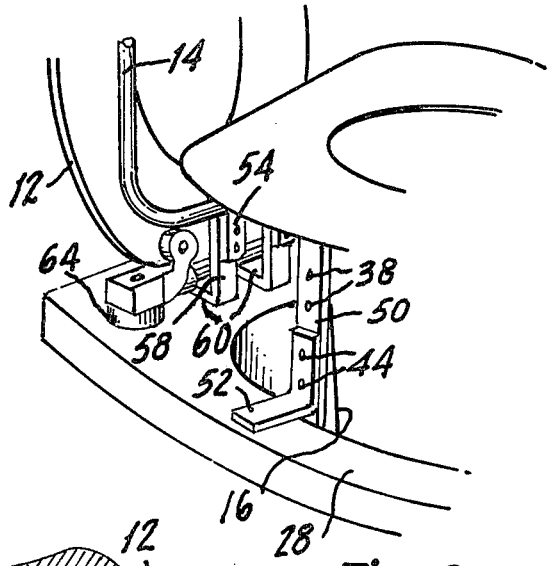
Fig. 6.
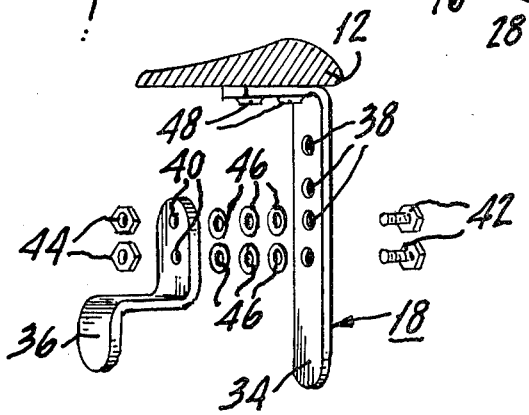
Fig. 7.
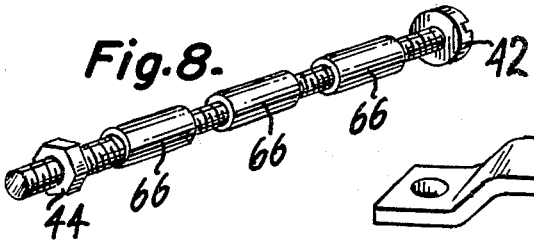
Fig. 8.
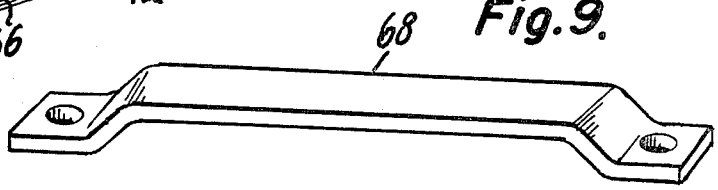
Fig. 9.
Fig. 10.
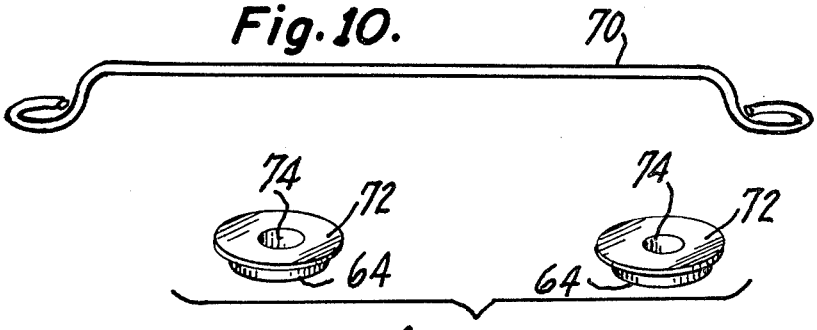
Fig. 11.

RAISED TOILET SEAT APPARATUS

BACKGROUND OF THE INVENTION

1. Field of the Invention

This invention relates to an improved raised toilet seat apparatus including structure to stabilize the device and prevent it from tipping while in use. 2. Description of the Prior Art A variety of raised toilet seats are known to those of ordinary skill in the art. The model No. 6910 Raised Toilet Seat has been sold by Edco, Inc. for a number of years. The Model No. 6910 includes four anodized, corrosion resistant, aluminum support brackets which engage the rim of a standard commode. The four support brackets are virtually identical to each other and include a foot portion which has an inverted U-shaped for cradling the relatively uniform rims of the bowl. The Model 6910 is effective for older model toilet bowls.

Over the years there has been a trend towards toilet bowls in which the rim does not have a uniform width. Typically the rim on many modern toilet bowls expands going from the front towards the back. In order to accomodate this structure, Edco, Inc. introduced the Model 6980 which included two front brackets similar to those on the 6910 but which also included three rear brackets which were adapted to lie flat on the surface of the rim of the bowl without cradling the outer edge. One of the three rear brackets extended under the hinge axel of the toilet seat to provide some additional stability against forward tipping. That structure was found to be acceptable for a variety of different applications.

It is known in the prior art to put arms or safety rails on raised toilet seats. Due to their awkwardness these structures often had to be permanently attached to the commode. This can be a problem when there are guests in the house. Accordingly, there has been a need for an easily removable, universal raised toilet seat which will also safely support the patient who uses it.

SUMMARY OF THE INVENTION

Briefly described the invention comprises an adjustable raised toilet seat which includes anti-tipping structure. The apparatus preferably includes a seat, a splash guard connected to the underside of the seat, a pair of safety rails also attached to the seat and disposed on opposite sides thereof and a set of adjustable brackets for supporting the seat above the rim of the bowl. A pair of L-shaped locking brackets are attached to the rear underside of the seat. The upright portion of each locking bracket is connected to a tab attached directly to the seat. A horizontal foot section is connected to the upright section and extends rearwardly of the apparatus. A typical conventional toilet seat includes a pair of mounting bolts which are received in the bowl and attached thereto by a set of corresponding nuts. A locking bar having a set of bolt receiving apertures at each end is mounted over the mounting bolts. A pair of spacer washers is also mounted over each of the mounting bolts respectively and serves to create a receiving gap between the underside of the locking bar and the upper surface of the bowl.

In operation the raised toilet seat apparatus is placed in position over the bowl and the horizontal foot sections of the two locking brackets are slipped into the gap formed between the locking bar and the bowl. Conversely the apparatus may be removed by lifting up on the rails and sliding the locking brackets out of engagement with the locking bar. The receiving gap between the locking bar and the vitreous china bowl is only slightly wider than the thickness of the horizontal portion of the locking brackets, thereby providing a relatively snug and secure slip-fit. The apparatus just described is universal in that it can be adapted to fit on a wide variety of standard and modern toilet bowl shapes.

Some institutions include toilet bowls in which the hinged cover is set back further from the interior of the bowl than is common in conventional household commodes. Therefore, according to one embodiment of the invention it is possible to place spacers between the upright sections of the locking brackets and the downward tabs connected to the toilet seat so as to effectively move the horizontal foot sections in a rearward direction so that it can engage a locking bar on an institutional type toilet.

Alternative embodiments of the locking bar include a locking bar having a bridge-like shape so as to avoid the necessity of spacers, a locking bar in the form of a thick U-shaped wire and the use of two relatively wide discs located above the spacer washers so as to provide a receiving gap for the locking brackets.

These and other features of the present invention will be more fully understood with reference to the following drawings and the detailed description of the invention.

BRIEF DESCRIPTION OF THE DRAWINGS

FIG. 5 illustrates the manner in which the raised toilet seat is installed on a conventional commode.

FIG. 6 is a detail view illustrating the manner in which the locking brackets are engaged under the locking bar.

FIG. 7 illustrates the manner in which the front support brackets may be adjusted to accomodate different bowl rims.

FIG. 8 illustrates the manner in which the locking brackets may be adjusted by means of spacers so as to accomodate institutional toilets.

FIG. 9 illustrates an alternative embodiment of the present invention in which the locking bar has a bridge-like shape.

FIG. 10 illustrates another alternative embodiment of the present invention in which the locking bar comprises a stiff wire element.

FIG. 11 illustrates yet another embodiment of the present invention in which the locking means comprises a pair of oversized discs mounted above a pair of smaller spacer washers.

DETAILED DESCRIPTION OF THE INVENTION

During the course of this description like numbers will be used to indicate like elements according to the different views of the invention.

Figure 1:
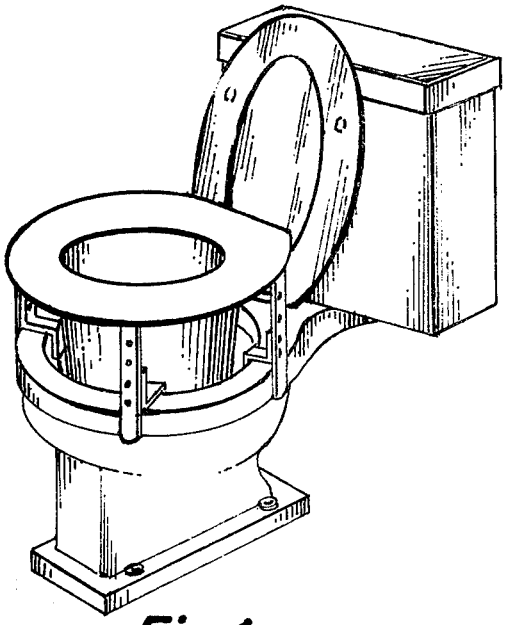
FIG. 1 is a prior art raised toilet seat similar to the Model No. 6910 distributed by Edco, Inc., of Passaic, N.J.

FIG. 1 illustrates a prior art Edco Model 6910 raised toilet seat. This device includes four identical support brackets which surround the rim with a U-shaped foot. This particular model will fit on a commode as long as the rim has a uniform width. Unfortunately, it will not fit on a modern type commode in which the thickness of the rim increases from front to back.

Figure 2:
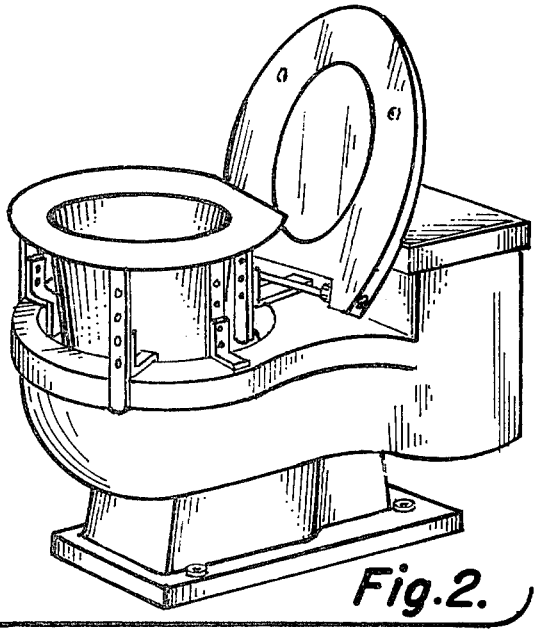
Fig.2. PRIOR ART
FIG. 2 is a prior art raised toilet seat similar to the Model No. 6980 distributed by Edco, Inc., of Passaic, N.J.

FIG. 2 illustrates a prior art Edco Raised Toilet Seat, Model 6980. The Model 6980 includes two front support brackets similar to those on the Model 6910. However, it also includes three rear brackets having the generalized shape of an L. The foot of each of the L-shaped brackets is adapted to rest upon the surface of the bowl, but is not formed to extend over and around the outside rim of the bowl in the same manner that the front support brackets engage the outside edge of the bowl. The foot section of one of the three rear brackets is adapted to fit between the toilet seat hinge axel and the rear surface of the bowl. The purpose of the single bracket is to increase stability by helping to anchor the apparatus against forward tipping. However, there were several drawbacks to the approach just described. Firstly, there was often a significant gap between the rear bracket and the toilet seat hinge axel thereby introducing undesirable play and instability into the apparatus. Secondly, there is a market for a raised toilet bowl having safety rails or arms on them to assist the user. This in turn increases the tortional forces on the apparatus causing it to tend to tip sideways. In general the single rear bracket of the sort employed with the Model 6980 is ineffective against sideways tipping moments. Thirdly, while the Model 6980 could be employed upon modern commodes, it was not completely universal due to variations in commode styles.

Figure 3A:
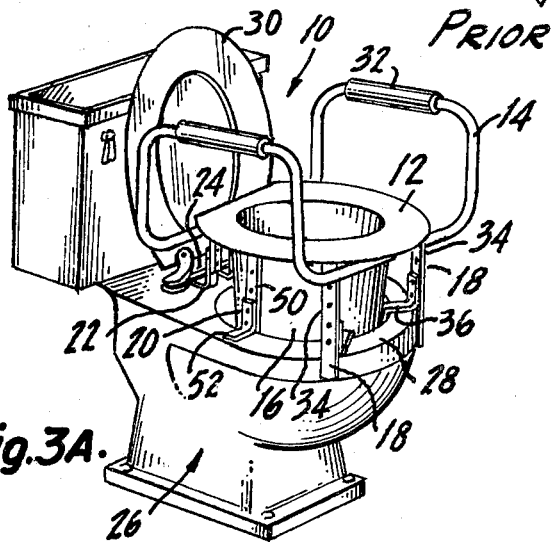
FIG. 3A is a perspective view of the raised toilet seat and safety rail apparatus according to the preferred embodiment of the present invention.
Figure 3B:
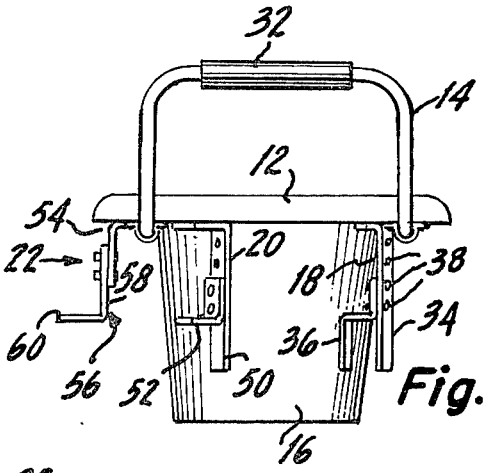
FIG. 3B is a side elevational view of the raised toilet seat apparatus.

A raised toilet seat and safety rail apparatus 10 according to the preferred embodiment of the invention is illustrated in perspective view in 3A. The invention 10 basically comprises a conventional seat 12, a wrap-around safety rail 14, a splash guard 16, a pair of front support brackets 18, a pair of rear support brackets 20, a pair of rear locking brackets 22 and a locking bar 24. The apparatus sits upon a conventional modern commode 26. The commode has a rim 28 which is of uniform thickness in the front but which widens towards the rear of the commode 26. Also associated with commode 26 is a conventional hinged toilet seat which is illustrated in the upright position in FIG. 3A.

The seat 12 is typically made out of wood. Therefore, rail 14, splash guard 16, front bracket 18, rear bracket 20 and locking brackets 22 are all attached to the underside of seat 12 by phillips head wood screws in a manner known to those of ordinary skill in the art. The rail 14 comprises a length of bent aluminum tubing which has both ends thereof clamped on the bottom side of the rear of seat 12. A pair of resilient rubber-like safety grips 32 are attached to the rail 14 and disposed on opposite sides of seat 12. The rail 14 allows the user to help himself on and off the seat 12. While in use the rail 14 also helps to support and reassure the user. The splash guard 16 is attached to the underside of seat 12 by a plurality of clips (not shown) similar to those employed on the prior art Edco Models 6910 and 6980. However, the splash guard 16 is preferably longer than is typically employed in the prior art to provide additional splash protection.

The front support brackets 18 include a downwardly directed tab 34 and a Z-shaped foot section 36. Tab 34 includes four apertures 38 therethrough. Correspondingly, Z-shaped element 36 includes two apertures 40 therethrough which are spaced apart the same distance as apertures 38. A pair of bolts 42 are adapted to pass through two apertures 38 in tab 34 and the two apertures 40 in tab 36. A pair of nuts 44 are then secured onto the bolts 42 in order to fasten Z-shaped bracket 36 to tab 34. A plurality of fiber spacer washers 46 can be used to adjust the spacing between bracket 36 and tab 34. Bracket 36 and tab 34 form an inverted U-shaped foot which is adapted to cradle the rim 28 of the bowl of the commode 26. The U-shaped foot is just slightly larger than the bowl rim so as to provide a relatively snug fit. Tab 34 is fastened securely to seat 12 by a pair of phillips head wood screws 48. Details of the construction of the front support bracket 18 may be more fully understood by referring to FIG. 7. According to the preferred embodiment of the invention the Z-shaped bracket 36 may be adjusted with respect to tab 34 so that the seat 12 can be located either 5" or 6" above the commode bowl.

The rear support bracket 20 comprises a downward tab 50 similar to front tab 34 and an L-shaped foot 52. The rear support brackets 20 are similar to the rear support brackets of the Edco prior art Model 6980 raised toilet seat. Tab 50 includes four adjusting holes 38 similar to the adjusting apertures 38 in front tab 34. L-shaped foot 52 also includes two apertures 40 similar to the two apertures 40 in the front Z-shaped bracket 36. Therefore, L-shaped bracket 52 can be adjusted upwardly or downwardly within a 1" range to accomodate a seat height adjustment of either 5" or 6". The front support bracket 18 differs from the rear support bracket 20 in that the front support bracket essentially surrounds the rim 28 of the bowl and overlaps the front exterior edge thereof. The rear bracket 20 does not overlap the exterior front edge because the rim thickness in the rear is not uniform from toilet bowl to toilet bowl.

The rear locking bracket 22 comprises a downwardly directed tab 54 and an L-shaped element 56 including an upright section 58 and a horizontal foot section 60 connected thereto. Downwardly directed tab 54 is attached to seat 12 in the same manner that tabs 34 and 50 are attached to the underside of seat 12. However, tab 54 is considerably shorter than tabs 34 and 50 and does not extend below the rim of the toilet bowl. Tab 54 includes two apertures therethrough which are adapted to receive a pair of bolts similar to those identified as elements 42 in FIG. 7. The upright section 58 includes three apertures therethrough and spaced apart the same distance as the apertures in the downwardly directed tab 54. Accordingly, it is possible to adjust the height of the bracket 26 for either 5" or 6" seat position.

The preferred embodiment of the invention also comprehends the use of a locking bar 24 which is received on the two mounting bolts 61 such as found on a typical standard toilet seat 30. Some toilet seats 30 include an axel which spans the two hinged sections of the seat.

Figure 4:
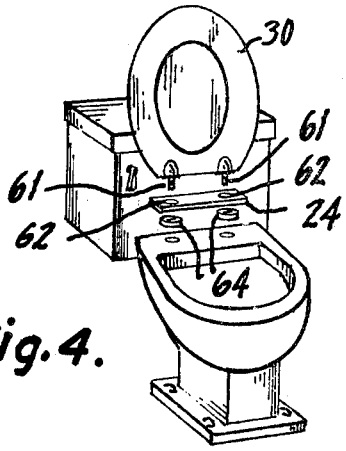
FIG. 4 illustrates the manner in which the locking bar is attached to the mounting bolts on a conventional commode.
Figure 3C:
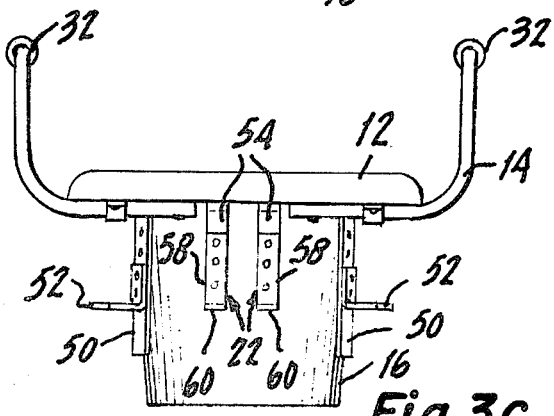
FIG. 3C is a rear elevational view of the raised toilet seat apparatus.

Those kind of seats made it possible to employ a single bracket such as found on the prior art Model 6980 illustrated in FIG. 2. In addition, many modern toilet seats do not include an axel between the hinges, thereby making the single rear bracket useless. The present invention is universally usable because an anchor or locking bar may be provided for virtually all commodes. In addition the locking bar 24 has uniform dimensions so as to snuggly and securely engage the horizontal foot section 60. The locking bar 24 illustrated in FIG. 4 includes a pair of apertures 62 adapted to receive mounting bolts 60. A pair of spacer washers 64 are also adapted to receive the mounting bolts 60 and to separate the locking bar 24 from the rim 28 of the toilet 26 by a fixed gap. The fixed receiving gap is only slightly wider than the thickness of the foot section 60 of the locking bracket 22.

The locking bar is mounted as follows. The toilet seat 30 is removed from the toilet bowl in the manner illustrated in FIG. 4. Mounting bolts 61 of the toilet seat are then placed through the apertures 62 in the locking bar 24. Spacer washers 64 are then slid over each of the mounting bolts 61. The toilet seat 30 is then remounted back on the toilet bowl in the conventional fashion so as to secure the locking bar 24 into position.

The device is then installed in the following manner. The raised toilet seat apparatus 10 is first placed on the toilet bowl rim 28. At the same time the horizontal foot section 60 of the locking bracket 22 is slid into the gap formed between locking bar 24 and the rear rim 28 of the commode 26. See FIG. 6. A slight inward pressure may be applied to the front support brackets 18 in order to be sure that they safely engage the front rim 28 of the bowl. This technique is illustrated in FIG. 5. For safe use, it is essential that the horizontal foot section 60 pass under the metal locking bar 24. If the front brackets 18 do not securely fit over the rim 28 of the bowl, then more or fewer fiber washers 46 may be placed between the downward tab 34 and the Zshaped bracket 36. See FIG. 7 for details.

The raised toilet seat may be easily removed by lifting upward on the front arms and sliding the locking bracket 22 out of the receiving gap formed between the locking bar 24 and the rim 28 of the bowl in the reverse manner to that described with respect to FIG. 5.

Figure 12:
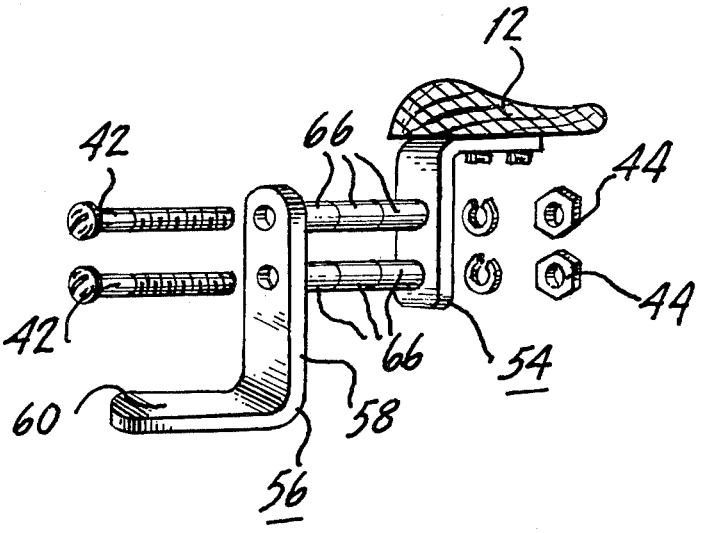
FIG. 12 illustrates the spacers shown in FIG. 8 in position.

Many institutions now use commodes in which the toilet seat hinges are placed further away from the rear rim of the toilet bowl than is typical with a conventional modern toilet seat. It is possible to use the apparatus of the present invention on such institutional commodes by moving the L-shaped section 56 of the rear locking brackets 22 in the rearward direction. This is accomplished by placing half-inch spacers 66 over the connecting bolts 42 as shown in FIGS. 8 and 12. The spacers 66 typically comprise a split bushing having a 1/16" wall thickness and a length of approximately ½". Institutional toilet seat hinges may be placed as far back as an additional 1½" beyond that normally associated with conventional commodes. Under those circumstances, the bolts 42 would preferably be about 2" long and would accomodate three ×½" spacers 66 so as to effectively displace the L-shaped locking bracket 56 rearward by an inch and a half.

The locking bar 24 may take a variety of different shapes. For example, it is possible to eliminate the spacer washers 64 by making the locking bar in the shape of a bridge or an inverted U such as illustrated by element 68 in FIG. 9. In this manner a gap is formed between the brackets 68 and the rim 28 of the bowl which is substantially the same depth as the gap receiving formed between the preferred locking bar 24 and the rim 28 as described in other parts of this disclosure.

The locking bar 24 can also take the form of an inverted U-shaped rod or wire 70 which spans the space between the two locking bolts 61. The wire 70 should preferably be stiff enough to hold the locking bracket 22 in place. One ⅛" wire is acceptable for this purpose.

Yet another embodiment of an acceptable locking bar 24 is illustrated in FIG. 11. A pair of oversized discs 72 are located directly above a pair of spacer washers 64. The diameter of the discs 72 is greater than the diameter of the spacer washers 64 so as to form an overhanging ledge. If the ledge is wide enough it will accomodate the foot 60 of the locking bracket 22. The discs 72 each include an aperture 74 through which the mounting bolts 61 will pass. The discs 72 have the advantage of being omni-directional and relatively inexpensive to manufacture and mount.

According to the preferred embodiment the brackets are formed from corrosion resistant anodized aluminum approximately 3/16" thick and about 1" wide. The arms rise approximately 7" above the surface of the seat and the distance between the foam padded rests 32 is approximately 18". The device when assembled weighs approximately 9 lbs. and has a shipping weight of 10 lbs. when packed one per carton.

There are several advantages to the present invention. First of all, it is highly resistant to lateral tipping as well as to forward tipping. Secondly, the device may be easily installed and removed from a commode. Thirdly, when the apparatus is removed, there is very little obvious evidence that the device was ever used. The only item remaining behind is the locking bar which is normally unobtrusive. Fourthly, the device is virtually universal in that it can be employed on a wide variety of toilets including those having uniform rims, rims of varying widths, institutional toilets with rearwardly disposed seat hinges and toilets which do not include a hinge axial rod. Fifthly, the apparatus is relatively inexpensive to manufacture, easy to assemble and readily cleanable.

While the invention has been described with reference to a preferred embodiment thereof, it will be understood by those of ordinary skill in the art that various modifications may be made to the elements thereof without departing from the spirit and scope of the invention.

I claim:

1. An improved raised toilet seat apparatus adapted to fit on a conventional commode of the type having a bowl and a hinged toilet seat connected to said bowl by two threaded mounting bolt means, said apparatus comprising:

a seat;

a splash guard connected to said seat;

a plurality of support bracket means connected to said seat for contacting said bowl and supporting said seat above said bowl;

at least two spaced apart L-shaped bracket means connected to said seat for stabilizing said apparatus, said L-shaped bracket means including an upright section connected to said seat and a horizontal foot section connected to said upright section; and, locking bar means including two aperture means therein for receiving said two threaded mounting bolts of said commode and for spanning the distance therebetween, said locking bar means forming a receiving gap between itself and said commode, wherein the horizontal foot section of said L-shaped bracket means has a thickness slightly less than said receiving gap between said locking bar means and said commode.

2. The apparatus of claim 1 wherein the upright section of said L-shaped brackets comprise two portions including:

a first tab portion directly connected to said seat and including a plurality of apertures therein;

a second portion connected to the lower horizontal section and also including a plurality of apertures therein; and, a plurality of bolt and nut means for passing through the apertures in said first and second portions to secure said first and second portions with respect to each other and to adjust the height relationship of the horizontal sections with respect to the seat by selectively locating said bolt and nut means in the appropriate apertures in said first and second portions.

3. The apparatus of claim 2 further including:

a pair of spacer washer means including apertures therein through which said mounting bolts of said toilet seat are receivable, wherein said locking bar means comprises a substantially flat locking bar mounted above said spacer washers.

4. The apparatus of claim 2 wherein said locking bar means comprises a rod including at both ends thereof a loop to form aperture means which receive said mounting bolts, said rod having a bridge-like shape so as to provide just enough clearance between said commode and said rod to allow the horizontal sections of said locking bracket means to fit snuggly between said rod and said commode.

5. The apparatus of claim 2 wherein said locking bar means comprises a flat bar having a bridge-like shape and apertures at both ends to receive said mounting bolts and wherein the space between said commode and said bar is just sufficient to allow the horizontal sections of said locking bracket means to slip thereunder and wherein said bar snuggly secures said horizontal sections when said horizontal sections are positioned between said bar and said commode.

6. The apparatus of claim 2 further including:

a plurality of hollow spacer means receivable on said bracket bolt means for selectively spacing said horizontal section backwards from said seat in order to accomodate institutional type commodes.

* * * * *